US006112169A

United States Patent [19]

Dolson

[11] Patent Number: 6,112,169

[45] Date of Patent: Aug. 29, 2000

[54] SYSTEM FOR FOURIER TRANSFORM-BASED MODIFICATION OF AUDIO

[75] Inventor: Mark Dolson, Ben Lomond, Calif.

[73] Assignee: Creative Technology, Ltd., Singapore, Singapore

[21] Appl. No.: 08/745,955

[22] Filed: Nov. 7, 1996

[51] Int. Cl.[7] ..... G10L 19/02

[52] U.S. Cl. ..... 704/205; 381/94.3; 704/206

[58] Field of Search ..... 704/200, 236, 704/254, 276, 203, 204, 205, 206, 207, 226; 381/94.2, 94.3; 382/191

[56] References Cited

U.S. PATENT DOCUMENTS

| | | | |
|---|---|---|---|
| 4,246,617 | 1/1981 | Portnoff . | |
| 4,829,574 | 5/1989 | Dewhurst et al. | 704/236 |
| 4,856,068 | 8/1989 | Quatieri, Jr. et al. . | |
| 4,885,790 | 12/1989 | McAulay et al. . | |
| 4,937,873 | 6/1990 | McAulay et al. . | |
| 5,054,072 | 10/1991 | McAulay et al. . | |
| 5,111,505 | 5/1992 | Kitoh et al. | 704/265 |
| 5,327,518 | 7/1994 | George et al. . | |
| 5,422,977 | 6/1995 | Patterson et al. | 704/276 |
| 5,602,959 | 2/1997 | Bergstrom et al. | 704/205 |

OTHER PUBLICATIONS

George Bryan et al., "Analysis–by–Synthesis/Overlap–Add Sinusoidal Modeling Applied to the Analysis and Synthesis of Musical Tones," *Journal of the Audio Engineering Society*, vol. 40, No. 6, Jun. 1992, pp. 497–516.

Griffin Daniel et al., "Signal Estimation From Modified Short–Time Fourier Transform," *IEEE Transactions on Acoustics, Speech, and Signal Processing*, vol. ASSP–32, No. 2, Apr. 1984, pp. 236–243.

Puckette Miller, "Phase–Locked Vocoder," 1995 IEEE ASSP Workshop on Applications of Signal Processing to Audio and Acoustics, Oct. 15–18, 1995, Mohonk Mountain House, New Paltz, New York, 4 pages.

Quatieri Thomas et al., "Phase Coherence in Speech Reconstruction for Enhancement and Coding Applications," IEEE International Conference on Acoustics, Speech, and Signal Processing, May 23–26, 1989, Scottish Exhibition Conference Centre Glasgow, Scotland, pp. 207–209.

Quatieri Thomas et al., "Speech Transformations Based on a Sinusoidal Representation," *IEEE Transactions on Acoustics, Speech, and Signal Processing*, vol. ASSP–34, No. 6, Dec. 1986, pp. 1449–1464.

McAulay Robert et al., "Speech Analysis/Synthesis Based on a Sinusoidal Representation," *IEEE Transactions on Acoustics, Speech, and Signal Processing*, vol. ASSP–34, No. 4, Aug. 1986, pp. 744–754.

Portnoff Michael, "Time–Scale Modification of Speech Based on Short–Time Fourier Analysis," *IEEE Transactions on Acoustics, Speech, and Signal Processing*, vol. ASSP–29, No. 3, Jun. 1981, pp. 374–390.

Sylvestre Benoit et al., "Time–Scale Modification of Speech Using an Incremental Time–Frequency Approach With Waveform Structure Compensation," IEEE International Conference on Acoustics, Speech, and Signal Processing, Mar. 23–26, 1992, The San Francisco Marriott, San Francisco, California, pp. from I–81 to I–84.

*Primary Examiner*—David R. Hudspeth
*Assistant Examiner*—Martin Lerner
*Attorney, Agent, or Firm*—Townsend and Townsend and Crew LLP

[57] ABSTRACT

A system and method for preserving the natural sound of a signal that is processed by an analysis step of converting the signal into a sequence of overlapping windowed DFT representations and a synthesis step of converting these DFT representations back to a time domain signal. For example, the system and method are applicable to analysis-synthesis systems based on a sequence of overlapping windowed, DFT representations in which either: (1) the analysis transforms overlap in time by a different amount than the synthesis transforms, or (2) the modification involves a re-mapping of transform values from one frequency location to another. The phases of the complex-valued DFT representations may be modified so that synthesis of the time domain signal results in a natural sound despite the effects of e.g., either (1) or (2).

20 Claims, 4 Drawing Sheets

SYSTEM FOR FOURIER TRANSFORM-BASED MODIFICATION OF AUDIO

COPYRIGHT NOTICE

A portion of the disclosure of this patent document contains material which is subject to copyright protection. The copyright owner has no objection to the xeroxographic reproduction by anyone of the patent document or the patent disclosure in exactly the form it appears in the Patent and Trademark Office patent file or records, but otherwise reserves all copyright rights whatsoever.

SOURCE CODE APPENDIX

A source code appendix is included herewith.

BACKGROUND OF THE INVENTION

In one embodiment, the present invention relates to methods and apparatus for modifying a digitized acoustic signal by means of systematic manipulation of the signal's discrete short-time Fourier transform.

It is well established that a discrete signal x(n) can be perfectly reconstructed from a sequence X (k,m) of its windowed Discrete Fourier Transforms (DFTs) by applying an inverse Discrete Fourier Transform to each DFT and then properly weighting and overlap-adding the sequence of inverse DFTs $$\hat{x}(n) = \sum_{m=-\infty}^{\infty} W(mL-n) \sum_{k=0}^{n-1} X(k,m) e^{j\frac{2\pi}{N}kn}$$

where $$X(k,m) = \sum_{n=-\infty}^{\infty} x(n) W(mL-n) e^{-j\frac{2\pi}{N}kn}$$

and L is the spacing between successive DFTs. It is also well known that modified versions of x(n) can be obtained by applying the above reconstruction formula to a sequence of modified DFTs.

In general, the DFT values are complex. Many useful modifications of the DFT values affect only their "magnitudes" (e.g., noise reduction, spectral-envelope modification, etc.). However, there are applications for which the phases of the DFT values must be modified (either instead of or in addition to the magnitude values).

The best known of these is frequency-domain time-scaling, in which the signal is stretched or shrunken in time while still preserving its original pitch. Since the underlying goal is to change the rate at which the signal's spectrum evolves in time, it is reasonable to accomplish this by taking a sequence of overlapping windowed DFTs and spacing them closer together (or further apart) during analysis than during synthesis.

A problem arises, however, in that the DFT phases must be modified in order to force the modified DFTs to overlap-add coherently upon resynthesis. This problem was first addressed by Portnoff, who suggested that the phase, $\phi(k,m)$ of the DFT value at frequency k for the m'th DFT be modified according to:

$$\hat{\phi}(k,m) = \phi(k,m-1) + \alpha[\phi(k,m) - \phi(k,m-1)]$$

where  is the time-scale factor. See, M. R. Portnoff, "Time-Scale Modification of Speech Based on Short-Time Fourier Analysis," IEEE Trans. Acoustics, Speech, and Signal Proc., pp. 374–390, vol. ASSP-29, No. 3 (1981), the contents of which are herein incorporated by reference for all purposes. This method produces good-sounding results when applied to speech or music, but it often introduces undesirable timbral alterations as well. To achieve the good-sounding results, the Portnoff technique requires that the synthesis transforms be overlapped so that L is no greater than 25% of N.

The reason for the timbral alterations is that Portnoff's algorithm accumulates phase for the DFT value at frequency k without regard for the phases of DFT values at frequency k−1 or k+1. Since phase accumulates independently in each frequency channel from the beginning of time, the phase relationships "within" each successive DFT gradually cease to be preserved in the modified DFTs.

Several solutions to this problem have been suggested in the literature. Sylvestre and Kabal proposed a scheme in which the signal is first partitioned into a set of contiguous signal-segments; Portnoff-style time-scaling is then applied to each signal-segment, with provisions for making the modified segments phase-continuous. See B. Sylvestre, et al., "Time-Scale Modification of Speech Using an Incremental Time-Frequency Approach with Waveform Structure Compensation," IEEE Int'l Conf. on Acoustics, Speech, and Signal Proc., pp. 81–84 (1992), the contents of which are herein incorporated by reference. This approach basically decreases the deleterious effects of the independently accumulated phases in each frequency channel by restricting the accumulation to a relatively short duration. The phase adjustment between successive signal-segments is addressed separately.

Puckette suggested that an effective "phase locking" of adjacent frequency channels could be obtained by modifying the Portnoff-style accumulated phase in each channel to bias it toward maintaining the original (unmodified) phase relationship across channels. His algorithm effectively replaces the default accumulated phase at frequency k for the m'th DFT frame that would have been provided by the Portnoff technique with a weighted average of the accumulated frequencies k−1, k, and k+1 for the m'th DFT frame.

Thus, while Sylvestre and Kabal segment the signal in time, Puckette simply averages DFT values across neighboring frequencies. Neither of these two solutions dramatically improve the resulting sound. The two solutions also do not offer greater computational efficiency.

Various other proposed solutions to the phase-modification problem present more radical departures from Portnoff's original framework, computing new phases, based either on iterative analysis-synthesis algorithms or on fitting each DFT to an explicit sinusoidal model. They make different fundamental assumptions and demand significantly more computation.

Thus, known approaches to frequency-domain time-scaling confront the phase-modification problem in one of two ways: Either they (1) preserve the underlying DFT analysis-synthesis structure of Portnoff and introduce simple time-domain segmentation or frequency-domain averaging to minimize the decorrelation of phase between original DFTs and modified DFTs, or they (2) abandon the Portnoff framework and compute new phases based either on iterative analysis-synthesis algorithms or on fitting each DFT to an explicit sinusoidal model.

There exists a need for computationally efficient approaches to modifying DFT phase values both in time-scaling and in frequency-warping applications. In particular, a DFT analysis-synthesis system capable of modifying the DFT phase values to either improve fidelity or decrease computational requirements would be highly useful.

SUMMARY OF THE INVENTION

The present invention provides a system and method for preserving the natural sound of a signal that is processed by an analysis step of converting the signal into a sequence of overlapping windowed DFT representations and a synthesis step of converting these DFT representations back to a time domain signal. For example, the present invention applies to analysis-synthesis systems based on a sequence of overlapping windowed, DFT representations in which either: (1) the analysis transforms overlap in time by a different amount than the synthesis transforms, or (2) the modification involves a re-mapping of transform values from one frequency location to another. The present invention provides for modifying the phases of the complex-valued DFT representations so that synthesis of the time domain signal results in a natural sound despite the effects of e.g., either (1) or (2). The present invention also provides computational efficiencies in that it has been found that only half as many analysis transforms need be computed as compared to the prior art.

In accordance with a first embodiment of the present invention, a method for preserving a natural sound of a sound signal after signal processing, including steps of registering a sequence of DFT representations that represent the sound signal, identifying significant peaks in DFT representations of the sequence, partitioning at least one DFT representation of the sequence into a set of contiguous frequency regions, such that each contiguous frequency region includes a single significant peak identified in the identifying step, computing a desired phase modification for a particular significant peak, and adjusting phases of other channels within a particular contiguous frequency region containing the particular significant peak so as to preserve original phase relationships across channels within the particular contiguous frequency region.

A further understanding of the nature and advantages of the inventions herein may be realized by reference to the remaining portions of the specification and the attached drawings.

DESCRIPTION OF SPECIFIC EMBODIMENTS

Figure 1:
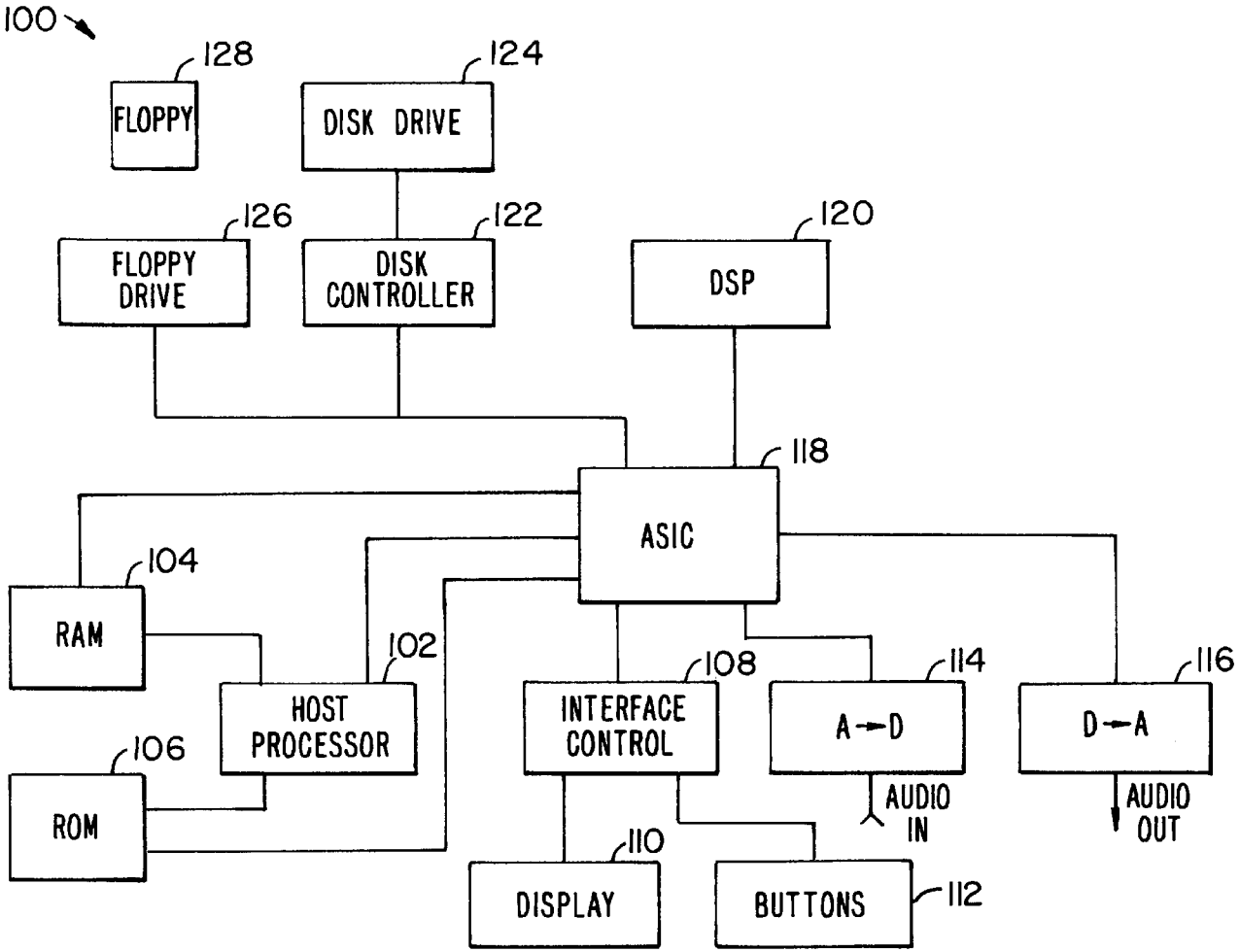
FIG. 1 depicts a signal processing system suitable for implementing the present invention.

FIG. 1 depicts a signal processing system 100 suitable for implementing the present invention. In one embodiment, signal processing system 100 captures sound samples, processes the sound samples in the time and/or frequency domain, and plays out the processed sound samples. The present invention is, however, not limited to processing of sound samples but also may find application in processing, e.g., video signals, remote sensing data, geophysical data, etc. Signal processing system 100 includes a host processor 102, RAM 104, ROM 106, an interface controller 108, a display 110, a set of buttons 112, an analog-to-digital (A-D) converter 114, a digital-to-analog (D-A) converter 116, an application-specific integrated circuit (ASIC) 118, a digital signal processor 120, a disk controller 122, a hard disk drive 124, and a floppy drive 126.

In operation, A-D converter 114 converts analog sound signals to digital samples. Signal processing operations on the sound samples may be performed by host processor 102 or digital signal processor 120. Sound samples may be stored on hard disk drive 124 under the direction of disk controller 122. A user may request particular signal processing operation using button set 112 and may view system status on display 110. Once sounds have been processed, they may be played out by using to D-A converter 116 to convert them back to analog. The program control information for host processor 102 and DSP 120 is operably disposed in RAM 104. Long term storage of control information may be in ROM 106, on disk drive 124 or on a floppy disk 128 insertable in floppy drive 126. ASIC 118 serves to interconnect and buffer between the various operational units. DSP 120 is preferably a 50 MHz TMS320C32 available from Texas Instruments. Host processor 102 is preferably a 68030 microprocessor available from Motorola.

For certain applications, signal processing system 100 will divide a sound signal, or other time domain signal into a series of possibly overlapping frames, obtain a windowed DFT for each frame, and resynthesize a time domain signal by applying the inverse DFT to the sequence of windowed DFT representations. The DFT for each frame is obtained by:

$$X(k,m)=\sum_{n=-\infty}^{\infty} x(n)W(mL-n)e^{-j\frac{2\pi}{N}kn}$$

where L is the spacing between frames, k is the frequency channel within a particular DFT, and m identifies the frame within the series. W(mL-N) is any window function as known to those of skill in the art. The resynthesized time domain signal is obtained by:

$$\hat{x}(n)=\sum_{m=-\infty}^{\infty} W(mL-n)\sum_{k=0}^{n-1} X(k,m)e^{j\frac{2\pi}{N}kn}$$

One such application is time scaling where the spacing, L, between the frames is changed for the synthesis step so that the resynthesized time domain signal is compressed or expanded as compared to the original time domain signal. Other applications involve changing the frequency positions of individual DFT channels prior to synthesis. The present invention provides a system and method for modifying phases in the DFT representations to maintain certain characteristics of the original time domain signal, e.g., a natural sound in the case of an acoustic signal.

Figure 2:
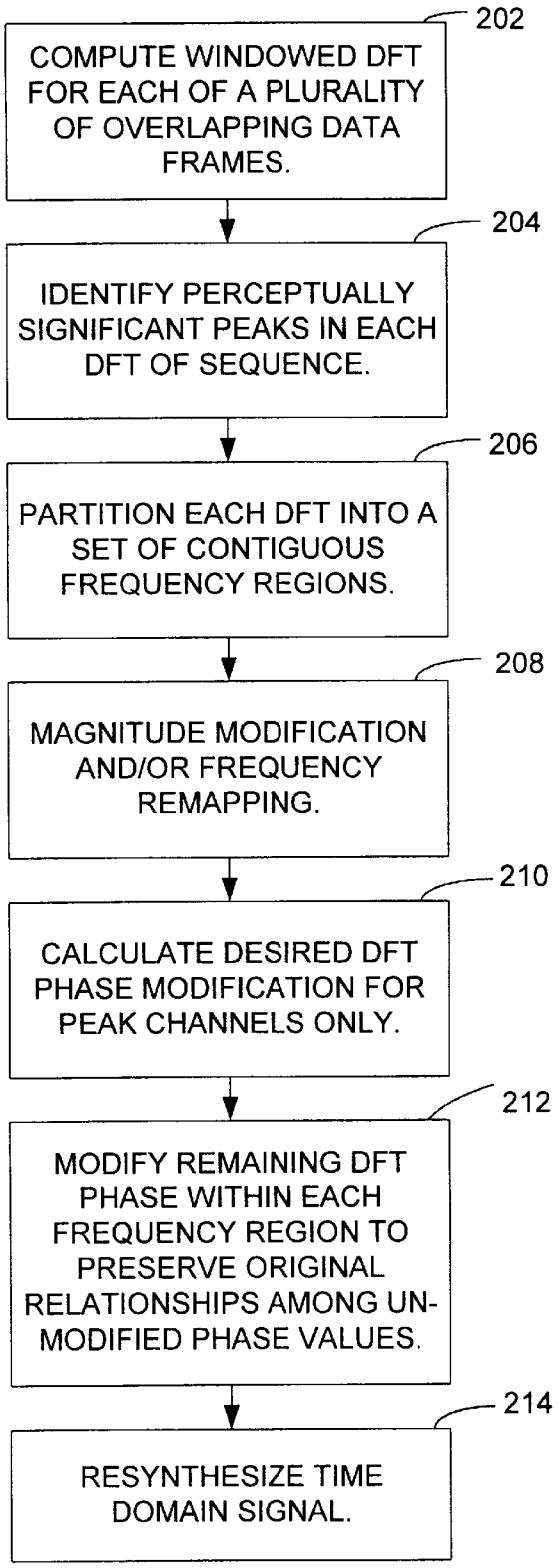
FIG. 2 is a flowchart describing steps of processing a sound signal while preserving a natural sound in accordance with one embodiment of the present invention.

FIG. 2 is a flowchart describing steps of processing a sound signal while preserving a natural sound in accordance with one embodiment of the present invention. FIG. 2 assumes that a sound signal has been converted to a sequence of samples that are available in electronic memory, e.g., RAM 104. At step 202, signal processing system 100 divides the sound signal into a series of overlapping data frames and applies a windowed DFT to each overlapping data frame. A sequence of DFT representations is therefore obtained. An advantage of the present technique is that the L value used for synthesis may be as high as 50% of N, rather than 25% as in the prior art, thus saving computation. Since the L value used for analysis is proportional to the L value used for synthesis, analysis computation time is also saved.

At step 204, signal processing system 100 identifies the significant peaks in the magnitude spectrum of each DFT representation. This may be done in any one of a number of ways. In one embodiment, local magnitude maxima more than two channels away from any greater local maxima are considered significant. At step 206, signal processing system 100 divides each magnitude spectrum into contiguous frequency regions. Each contiguous frequency region includes a single significant peak. The borders between contiguous frequency regions may be selected in a number of ways. In one embodiment, the channel midway between two significant peaks becomes the border between the corresponding contiguous frequency regions.

Figure 3:
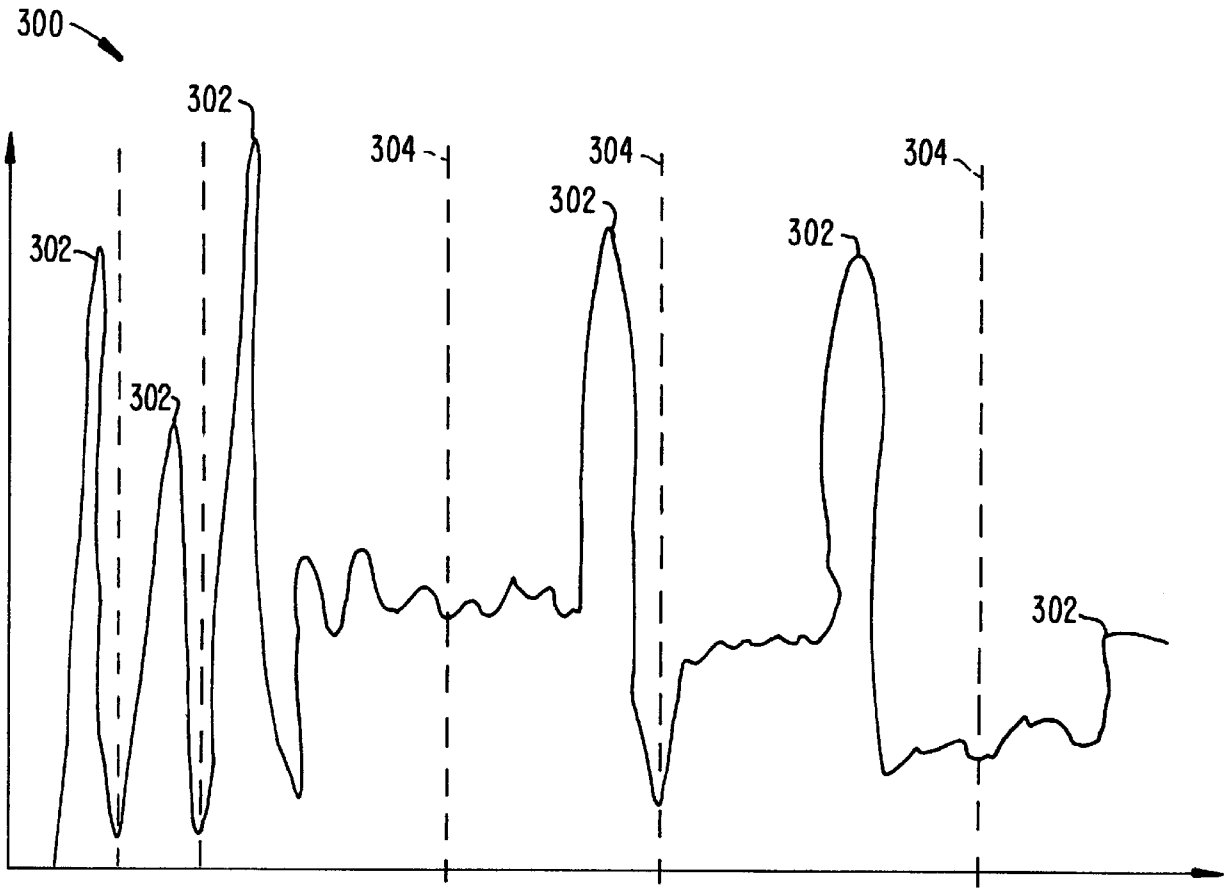
FIG. 3 depicts identification of significant peaks within a DFT spectrum and division of the DFT spectrum into contiguous frequency regions in accordance with one embodiment of the present invention.

FIG. 3 depicts identification of significant peaks within a DFT spectrum and division of the DFT spectrum into contiguous frequency regions in accordance with one embodiment of the present invention. A spectrum 300 represents the magnitude component of one of the DFT representations of the sequence. Peaks 302 have been identified as significant peaks. Spectrum 300 has been divided into contiguous frequency regions separated by borders 304.

Step 208 is an optional step of directly manipulating magnitude values within the sequence of DFT representations and/or remapping frequencies. At step 210, signal processing system 100 computes a desired DFT phase modification but preferably only for each significant peak in each DFT representation rather than for every channel. For the time scaling application, this DFT phase modification is preferably computed using the formula developed by Portnoff: $\hat{\phi}(k,m)=\phi(k,m-1)+\alpha[\phi(k,m)-\phi(k,m-1)]$, where $\alpha$ is the time compression or expansion factor.

Figure 4:
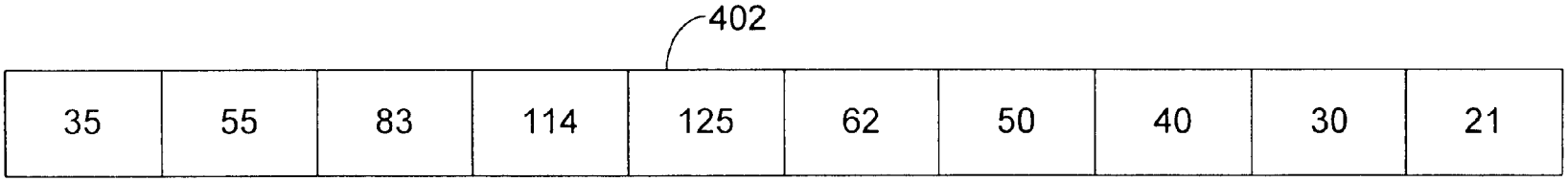
FIG. 4 depicts phase values within a particular contiguous frequency region of a particular DFT spectrum prior to processing in accordance with one embodiment of the present invention.
Figure 5:
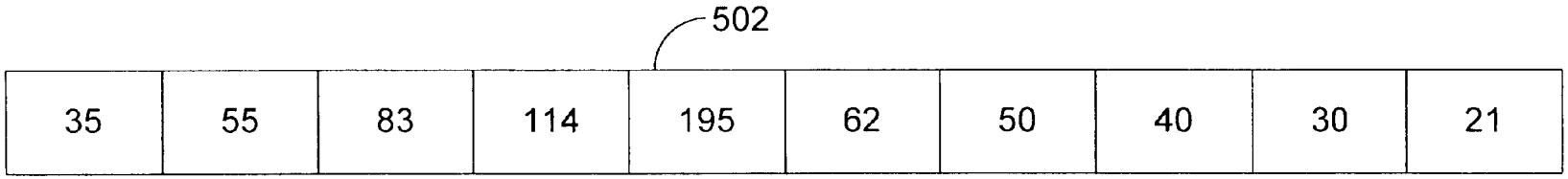
FIG. 5 depicts phase values within a particular contiguous frequency region wherein phase of a significant peak has been modified in accordance with one embodiment of the present invention.

FIG. 4 shows the phase values for a 10 channel wide contiguous frequency region of a particular DFT representation prior to step 208. A value 402 corresponds to the significant peak of this region. FIG. 5 shows the phase values for the same region after step 210. Value 402 has changed to a new value 502 according to the Portnoff formula whereas the phases of the other channels remain unchanged.

Figure 6:
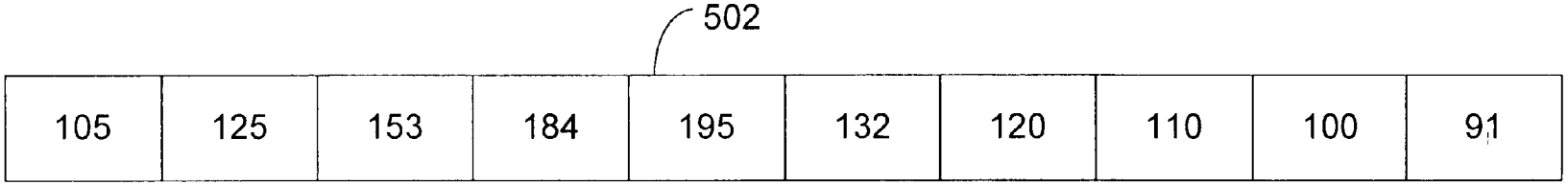
FIG. 6 depicts phase values within a particular contiguous frequency regions wherein phases have been modified to preserve an original relationship among the frequencies.

At step 212, signal processing system 100 computes the remaining phase values in each contiguous frequency regions. These are determined so as to preserve the original relationship between phase values, despite the change in the phase value of the significant peak. In one embodiment, the phase values are simply shifted by adding or subtracting the same number that was added to or subtracted from the phase value for the significant peak. This preserves the linear differences among the phases. FIG. 6 shows the phase values additively shifted to match the change in phase value for the perceptually significant peak.

Once the phase values have been modified in this way, at step 214 the time domain signal is resynthesized by applying the inverse DFT to each DFT representation in the sequence and properly weighting and overlap-adding the sequence of inverse DFTs. For time scaling applications, the spacing L is adjusted to provide the desired time compression or expansion.

Source code written in the C language for implementing elements of the present invention is included in the appendix included herewith. After compilation and linking using software available from Texas Instruments, the source code will run on the TMS320C32 digital signal processor.

In the foregoing specification, the invention has been described with reference to specific exemplary embodiments thereof. For example, signal processing system 100 may be implemented as a standard computer system. It will, however, be evident that various modifications and changes may be made thereunto without departing from the broader spirit and scope of the invention as set forth in the appended claims and their full scope of equivalents.

What is claimed is:

1. A method for preserving a natural sound of a sound signal after signal processing, comprising:

registering a sequence of transform representations that represent said sound signal;

identifying significant peaks in said transform representations of said sequence, wherein each significant peak is defined, in part, by a magnitude and a phase value;

partitioning at least one transform representation of said sequence into a set of contiguous frequency regions, such that each contiguous frequency region includes a single previously identified significant peak and covers a plurality of channels, wherein each channel is associated with a particular phase value;

for a particular contiguous frequency region, computing a desired phase modification for a phase value associated with said identified significant peak; and adjusting phase values associated with remaining channels in said particular contiguous frequency region based on said desired phase modification so as to preserve said natural sound.

2. The method of claim 1 further comprising:

modifying a magnitude of said identified significant peak.

3. The method of claim 1 further comprising:

modifying a frequency of said identified significant peak, prior to said computing said desired phase modification.

4. The method of claim 1 wherein said signal processing comprises time scaling by a factor $\alpha$, and said method further comprising:

converting said sequence of transform representations back to a time domain signal, wherein a spacing between said transform representations is selected to achieve said time scaling.

5. The method of claim 1 wherein said computing said desired phase modification comprises:

computing a new phase value $\phi\hat{}(k,m)$ for said identified significant peak to be $\{\phi(k,m-1)+\alpha[\phi(k,m)-\phi(k,m-1)]\}$, wherein k is a channel number of said identified significant peak and m identifies the transform representation within said sequence in which said peak is found.

6. The method of claim 1 wherein said adjusting comprises:

linearly shifting each phase value associated with each remaining channel.

7. The method of claim 1 further comprising modifying said phase value associated with said identified significant peak with said desired phase modification.

8. A signal processing system configured to preserve a natural sound of a sound signal after signal processing, comprising:

a processing unit; and a memory configured to store digital samples representing a sound signal, said memory further configured to store codes for registering a sequence of transform representations that represent said sound signal;

identifying significant peaks in said transform representations of said sequence, wherein each significant peak is defined, in part, by a magnitude and a phase value;

partitioning at least one transform representation of said sequence into a set of contiguous frequency regions, such that each contiguous frequency region includes a single previously identified significant peak and covers a plurality of channels, wherein each channel is associated with a particular phase value;

for a particular contiguous frequency region, computing a desired phase modification for a phase value associated with said identified significant peak; and adjusting phase values associated with remaining channels in said particular contiguous frequency region based on said desired phase modification so as to preserve said natural sound.

9. The system of claim 8 wherein said memory is further configured to store code for modifying a magnitude of said identified significant peak.

10. The system of claim 8 wherein said memory is further configured to store code for modifying said phase value associated with said identified significant peak with said desired phase modification.

11. The system of claim 8 wherein said signal processing comprises time scaling by a factor $\alpha$, and wherein said memory is further configured to store code for converting said sequence of transform representations back to a time domain signal, wherein a spacing between said transform representations is selected to achieve said time scaling.

12. The system of claim 8 wherein said computing code comprises code for computing a new phase value $\hat{\phi}(k,m)$ for said identified significant peak to be $\{\phi(k,m-1)+\alpha[\phi(k,m)-\phi(k,m-1)]\}$, wherein k is a channel number of said identified significant peak and m identifies the transform representation within said sequence in which said peak is found.

13. The system of claim 8 wherein said adjusting code comprises code for linearly shifting each phase value associated with each remaining channel.

14. A computer program product for preserving a natural sound of a sound signal after signal processing, said product comprising:

code for registering a sequence of transform representations that represent said sound signal;

code for identifying significant peaks in said transform representations of said sequence, wherein each significant peak is defined, in part, by a magnitude and a phase value;

code for partitioning at least one transform representation of said sequence into a set of contiguous frequency regions, such that each contiguous frequency region includes a single previously identified significant peak and covers a plurality of channels, wherein each channel is associated with a particular phase value;

code for computing, for a particular contiguous frequency region, a desired phase modification for a phase value associated with said identified significant peak;

code for adjusting phase values associated with remaining channels in said particular contiguous frequency region based on said desired phase modification so as to preserve said natural sound; and a computer-readable storage medium configured to store the codes.

15. The product of claim 14 further comprising:

code for modifying a magnitude of said identified significant peak.

16. The product of claim 14 further comprising:

code for modifying a frequency of said identified significant peak, prior to operation of said computing code.

17. The product of claim 14 wherein said signal processing comprises time scaling by a factor $\alpha$, and said product further comprising:

code for converting said sequence of transform representations back to a time domain signal, wherein a spacing between said transform representations is selected to achieve said time scaling.

18. The product of claim 14 wherein said computing code comprises:

code for computing a new phase value $\hat{\phi}(k,m)$ for said identified significant peak to be $\{\phi(k,m-1)+\alpha[\phi(k,m)-\phi(k,m-1)]\}$, wherein k is a channel number of said identified significant peak and m identifies the transform representation within said sequence in which said peak is found.

19. The product of claim 14 wherein said adjusting code comprises:

code for linearly shifting each phase value associated with each remaining channel.

20. The product of claim 14 further comprising code for modifying said phase value associated with said identified significant peak with said desired phase modification.

* * * * *